United States Patent [19]

Eicher et al.

[11] Patent Number: 5,040,453

[45] Date of Patent: Aug. 20, 1991

[54] ACTUATOR HOUSING CONTINUATION

[75] Inventors: Fred Eicher, Prospect; Charles F. Evans, Jr., Louisville, both of Ky.

[73] Assignee: Turn Act Inc., Jeffersontown, Ky.

[21] Appl. No.: 910,626

[22] Filed: Sep. 23, 1986

Related U.S. Application Data

[63] Continuation of Ser. No. 399,448, Jul. 12, 1982, abandoned.

[51] Int. Cl.[5] ..... F01C 9/00

[52] U.S. Cl. ..... 92/122; 92/125; 92/169.1

[58] Field of Search ..... 92/120, 121, 122, 125, 92/169.1, 169.2, 169.3, 169.4

[56] References Cited

U.S. PATENT DOCUMENTS

| | | | |
|---|---|---|---|
| 611,493 | 9/1898 | Krogstad | 92/125 X |
| 3,179,020 | 4/1965 | Rumsey et al. | 92/125 |
| 3,272,082 | 9/1966 | Bertram et al. | 92/121 X |
| 3,276,332 | 10/1966 | Jaffe | 92/125 X |
| 3,307,488 | 3/1967 | Hinckley | 418/149 X |
| 3,379,100 | 4/1968 | Rumsey et al. | 92/120 X |
| 3,665,835 | 5/1972 | Oates | 92/122 X |
| 3,680,982 | 8/1972 | Jacobellis | 92/121 |
| 4,174,655 | 11/1979 | Valente | 92/122 |

FOREIGN PATENT DOCUMENTS

| | | | |
|---|---|---|---|
| 630340 | 3/1963 | Belgium | 92/169 |
| 2049631 | 4/1972 | Fed. Rep. of Germany | 92/169 |
| 2912432 | 10/1980 | Fed. Rep. of Germany | 92/169 |
| 574700 | 1/1946 | United Kingdom | 92/122 |

*Primary Examiner*—Edward K. Look
*Assistant Examiner*—Thomas E. Denion
*Attorney, Agent, or Firm*—Edward M. Steutermann

[57] ABSTRACT

The present invention provides housing member for a rotary fluid powered actuator including a cylindrical housing member having an opening in at least one end, a head member received on each open end of the housing where each head has a central aperture in generally aligned relation with the longitudinal axis of the housing, a shaft member to extend through the central aperture for rotation therein and journal means to journal the shaft in the housing adjacent each end thereof and a vane member to extend outwardly from the shaft member for rotation therewith in response to fluid pressure in the housing where the housing member includes at least one stator member, integral therewith extending radially inwardly from the sidewall of the housing and adapted to receive a seal member to provide a seal between the termination of the stator and the shaft and members extending along a portion of the length of the housing to define bolt passages, and bolt members to be received in the bolt passage where the bolt members contact the surface of the bolt passage and connect the head to the body at the end opposed to the open end.

5 Claims, 3 Drawing Sheets

ACTUATOR HOUSING CONTINUATION

BACKGROUND OF THE INVENTION

This application is a Continuation of 399,448 filed July 19, 1982 now abandoned.

This invention relates generally to fluid motors, and more particularly to generally cylindrical body members for vane operated fluid actuated, oscillating reversing motors adapted to provide reciprocatory rotary motion through a portion of a revolution.

Devices of the type are capable of many uses such as closing or opening valves, toggling, camming, clamping, positioning, etc. and the like or performing other services, particularly where "push-pull" or reciprocatory movements are involved. Such actuators usually embody head members disposed in sealing relation on opposite ends of a cylindrical body to define a chamber in which a vane is rotated bidirectionally about an axis extending through the housing by fluid pressure applied in the housing at one side of the vane. In such arrangements the vane is impelled to and fro by the pressure of the fluid admitted to one side or the other of the vane within the chamber and with the concurrent exhaust of fluid at the opposite side. Stators are usually provided to define sectional chambers within the housing.

In such devices fluid leakage and the minimum torque necessary to "break away" the rotor have been major concerns The invention disclosed in our U.S. Pat. No. 4,474,105, issued Oct. 2, 1984 and U.S. Pat. No. 4,475,738 issued Oct. 9, 1984 have dealt with these concerns. Also it has been found that the loading imposed on such devices by selective movement of the vane and the tremendous kinetic forces generated by loading on the shaft, which are instantaneously transferred to the stators from the vane, significantly affect the operation and life of the device. Further, it has heretofore been necessary to design the body of the device to accommodate these forces and hold the stators stationary to prevent leakage as a result of the severe impacting of the vane on the stator. Also, it has been found that in devices in accordance with the present invention because of the contact between the bolt and lobe the forces are also transferred to the bolts. Accordingly, it has previously been necessary to provide a body with enough strength not only to hold the pressurized fluid but also to accommodate the forces resulting from operation of the vane.

In previous arrangments of such rotary type actuators the stators have generally been separate parts connected to the housing by bolts or other devices extending through holes in the housing to be received in threaded and tapped holes in the face of the stator which abuts the housing wall. It has been found that such an arrangement after such impact by the vane on the stator is loosened to provide a fluid leah path between the stator and the housing and, more importantly, from one chamber to another within the housing on opposite sides of the vane causing loss of torque even though seals are provided.

Further it has been found that the use of separate stators greatly increase the material and labor costs of the device. Additionally, in prior art devices the heads are usually retained at opposite ends of the housing by bolts which extend the length of the housing and are connected to the opposed heads. As a result alignment of the heads and stators require the use of alignment pins between the head and housing. The pins are also used to provide additional stability to the device but likewise increase cost and complexity of the device.

Prior art arrangements generally provide seals for pneumatic system where the leakage rate is in the order of 0.1 cubic feet per minute and in some instances the leak rate is considerably higher. This leak rate of prior art is unacceptable in some applications. Devices within the scope of the present invention produces product with leak rates not exceeding 0.005 cu ft/min.

One prior art arrangement is shown in U.S. Pat. No. 3,128,679,—Trendle wherein a rotary device is shown having a chamber with a vane and a seal arrangement including an internal seal formed around the inner end of a shaft bore where the shaft passes through the head of the device. Trendle utilizes a seal member of generally square cross section.

Somewhat similar devices are shown in U.S. Pat. Nos. 2,806,451—Vinkler and No. 3,682,050—Hyde. In both arrangements, two piece vane seals are shown.

Other arrangments for vane type actuators are shown in U.S. Pat. No. 3,131,610—Paulus, wherein a seal arrangement is provided around the entire periphery of the vane and in U.S. Pat. No. 3,179,020 where a split vane is provided with a seal captured between the sections of the vane.

No prior housing is known for use in an actuator device which provides stiffening of the housing and eliminates the separate stator members utilized in prior rotary actuator device to prevent rolling or twisting of the stator, housing and heads under dynamic conditions which, in accordance with the present invention have been found to be a principal source of motive fluid leakage.

SUMMARY OF THE INVENTION

The present invention provides a novel one piece housing for a fluid powered actuator which includes a shaft which carries a vane movable between first and second positions less than one full revolution apart and where the housing is contained between heads at each end thereof and includes internal stators to selectively limit movement of the vane and shaft assembly, and absorb the kinetic energy of the load carried by the vane and shaft.

The present invention provides arrangements which can provide significant cost reduction in both labor and materials. Specifically devices within the scope of the present invention can eliminate up to nine separate components and the labor associated with the assembly of the parts required in prior art arrangement and improve the mechanism and fluid integrity of the devices.

Moreover, housings in accordance with the present invention can provide a housing with external lobes to receive bolts which extend between, and hold, the heads to the body where the bolts are in contact with the lobe surfaces to prevent twisting of the housing relative to the head under load which occurence has been found to be a principal source of internal fluid leaks in the device.

It has been found that fluid leakage between the stators and housing is a serious detriment of previous devices and having within the scope of the present invention is advantageously provided of one piece construction to eliminate the leakage.

The one piece construction provided by the present invention which includes the stator, greatly strengthens the stator assembly to prevent movement of the stator where impacted by the vane. Further, by elimination of the stator movement, exact vane rotation is accomplished.

Likewise the one piece construction eliminates the pins used in prior art devices to locate and stablize the stator and allows greater flow capacity which improves the operating characteristics of the device.

Further, the housings provided by the present invention can include lobes defined on the outer surface of the housing to receive bolts to secure heads to at least one opening in the housing and, advantageously eliminate the alignment pins used in previous devices.

While the present invention can include arrangements where only one end of the housing is open and one end of the shaft is journaled in the end walls of the housing opposite the open end which is adapted to receive the head, the example of the present invention described herein shows only arrangements where both ends of the housing are open and a head is provided at each end.

More particularly, the present invention provides a housing member for a rotary fluid powered actuator including a cylindrical housing member having an opening in at least one end, a head member received on each open end of the housing where each head has a central aperature in generally aligned relation with the longitudinal axis of the housing, a shaft member to extend through the central aperture for rotation therein and journal means to journal the shaft in the housing adjacent each end thereof and a vane member to extend outwardly from the shaft member for rotation therewith in response to fluid pressure in the housing where the housing member includes at least one stator member, integral therewith extending radially inwardly from the sidewall of the housing terminating adjacent the shaft and adapted to receive a seal member to provide a seal between the termination of the stator and the shaft and lobe members extending outwardly from the housing substantially along the length of the housing to define bolt passages, and bolt members to be received in the bolt passage where the bolt members contact the surface of the bolt passage and connect the head to the body at the end opposed to the open end.

Examples within the scope of the present invention are illustrated and described in the accompanying drawings and it will be understood that various other arrangements also within the scope of the present invention will occur to those skilled in the art upon reading the disclosure set forth hereinafter.

BRIEF DESCRIPTION OF THE DRAWINGS

Examples in accordance with the present invention are shown in the accompanying drawings wherein.

DETAILED DESCRIPTION OF THE DRAWINGS

Figure 1:
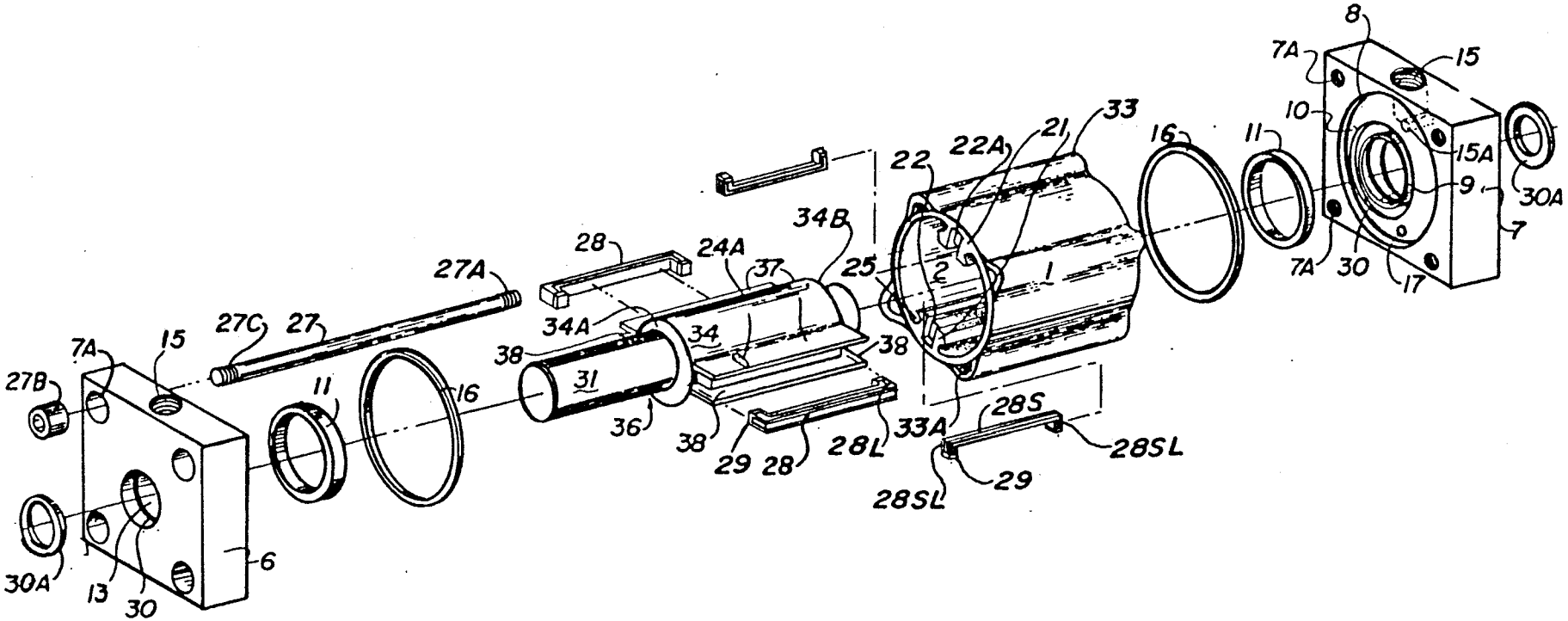
FIG. 1 is an exploded view of one arrangement within the scope of the present invention.

Referring first to FIG. 1 which is an exploded view of one arrangement within the scope of the present invention for 90 degree rotation of the shaft as shown in our previously described copending application, a cylindrical body 1 is shown defining an internal chamber 2 to receive the elements illustrated in exploded form.

Body 1 can be fabricated from any suitable material and in the example shown can be extruded aluminum or plastic material. The body can also be fabricated by other means such as machining.

It has been found that the unique body arrangement provided by the present invention permits the use of a commercial process to extrude the body to provide significant cost savings over prior art devices requiring separate assembly of the body and stators. Also by providing a design which extruded the device can be fabricated in any desired length.

As previously discussed the Figures illustrate an arrangement where open ends are provided at opposite ends of the housing, but it will be understood that the arrangements where one end is enclosed are also within the scope of the present invention.

Heads 6 and 7 are provided at opposite ends of body 1 and each includes an annular groove 8 (the corresponding annular groove and inner side configuration of head 6 not being shown, it being understood that heads 6 and 7 are the same in that each includes aligned grooves where head 6 is adapted to be received on the end of body 1 opposite the end receiving head 7) to receive sealing ring 16 where body 1 is received in heads 6 and 7 in sealing relation on seals 16.

A second internal groove 9 is provided in each head 6, 7 inset from a central opening 13 as described hereinafter. A recessed bearing surface 10 is provided in each head inside groove 8 to receive the seals of a rotor vane and stator as described hereinafter. A central aperture 13 is provided in each head 6, 7, as shown where in assembled form apertures 13 are in longitudinally aligned relation to receive opposite ends of a shaft 31 of a rotor assembly as described hereinafter. A peripherial internal groove 30 can be provided in each of the central apertures 13 of each head 6 and 7 to receive an "O" ring seal 30A to prevent inward migration of grit or other contaminates.

Each head 6 and 7 is provided with communicating fluid inlet/outlet 15–15A to communicate with chamber 2 to provide admisssion and exhaust of operating fluid when the unit is assembled. In FIG. 1, aperture 15 is shown communicating with an aperture 15A in head 7. A similar fluid inlet/outlet is provided in head 6 but is not shown where only opening 15 of head 6 is shown.

A rotor assembly 36 is provided with, for example, vanes 37 extending outwardly from an enlarged portion 34 of generally circular outer peripherial configuration and carried intermediate the ends of shaft 31. While an arrangement is shown in FIG. 1 providing two vanes, other arrangements providing single or multiple vane can also be included within the scope of the present invention for use in devices operable between other limits.

The surface of enlarged portion 34 provides a stator vane sealing surface and extends along a portion of the length of shaft 31 which is approximately equal to the length of body 1 so ends 34A and 34B of enlarged portion 34 abut seals 11 of heads 6, 7, when the unit is assembled as described hereinafter. Each vane 37 includes grooves 38 around the free periphery thereof adapted to receive channel shaped sealing members 28 within the scope of the present invention as described hereinafter.

In the arrangement shown cross bores 24A are provided to extend through enlarged portion 34 and shaft 31 to facilitate application of fluid pressure to opposite sides of the vane as is known in the art.

A pair of stators 21 are provided and in the arrangement in accordance with the present invention are extruded as part of body 1. As indicated, stators 21 are an integral part of the housing and have free edges at opposite ends thereof which are located, respectively, adjacent the inner surface of heads 6, 7, and an outer edge which is located adjacent the surface of enlarged portion 34. Each stator 21 is generally the same length as body 1 and a groove 22 extends the length of each stator. A laterally extending groove 22 to extend radially toward the outer surface of body 1. Seals 28S are provided to be received in grooves 22, between the inner surface of the stator and body 1 to prevent fluid leakage through apertures 3 provided in body 1. Also each groove 22A of each stator 21 is adapted to receive a depending leg 28SL of channel shaped sealing member 28A where legs 28SL terminate in a pad 29.

A longitudinally extending groove 25 can be provided in each side of each stator 21 where one of the grooves 25 is adapted to be positioned in aligned relation with an aperture 15A of one head 6, 7, as described hereinafter to facilitate selective admission/emission of fluid to and from chamber 2.

Figure 2:
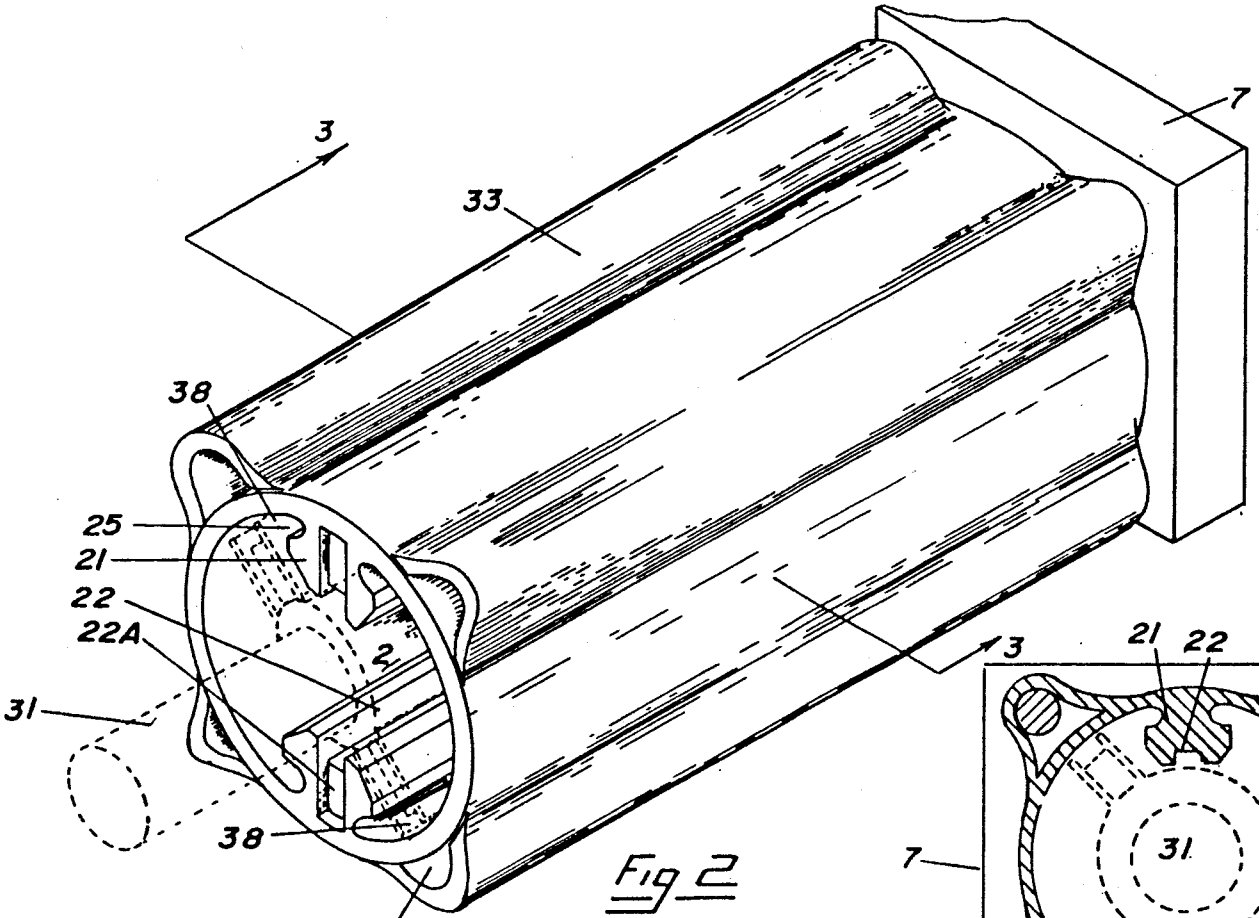
FIG. 2 is a perspective enlarged view of a housing within the scope of the present invention with a rotor.

The unit is assembled as indicated in FIG. 2 and held by bolts 27 shown in FIG. 1 which have threaded ends 27A, 27C received in holes 7A of head 7 and extend between heads 6 and 7 with body 1 there between to receive nuts 27B on threaded ends 27C. Alternatively a cap screw (not shown) can be utilized.

Figure 3:
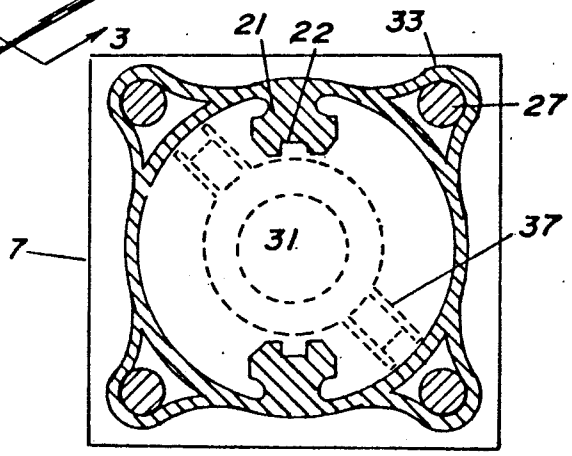
FIG. 3 is a cross section of the seal arrangement of FIG. 2 taken through a plane passing through line 3—3 of FIG. 2.

In accordance with another feature of the present invention shown in FIG. 1 lobes 33 are provided as an integral part of body 1 and extend generally the length thereof to receive bolts 27 in openings 33A defined by the lobes. As shown in FIG. 3 bolts 27 can engage the sides of lobes 33 of body 1 within the lobes. In accordance with one feature of the present invention it has been found that the lobes which receive the bolts 27 result in significant strengthening of the body, allow use of somewhat reduced body thickness and, significantly, transfer the torque experienced by the body to heads 6, 7 and to greatly reduce fluid leakage within the unit and improve effectiveness of the seals. Further the lobes have been found to allow the use of much higher operating pressures.

Referring to FIG. 1 a perspective view of a seal 28 is shown which can be used in vanes 37 and received in grooves 38. Seal 28 as shown in channel shaped similar to seal 28A where laterally extending generally parallel legs 28L at opposite ends are received in the radially extending portions of groove 38. Pads 29 are provided at the ends of legs 28L to seal on sealing rings 11 as described hereinafter.

Figure 4:
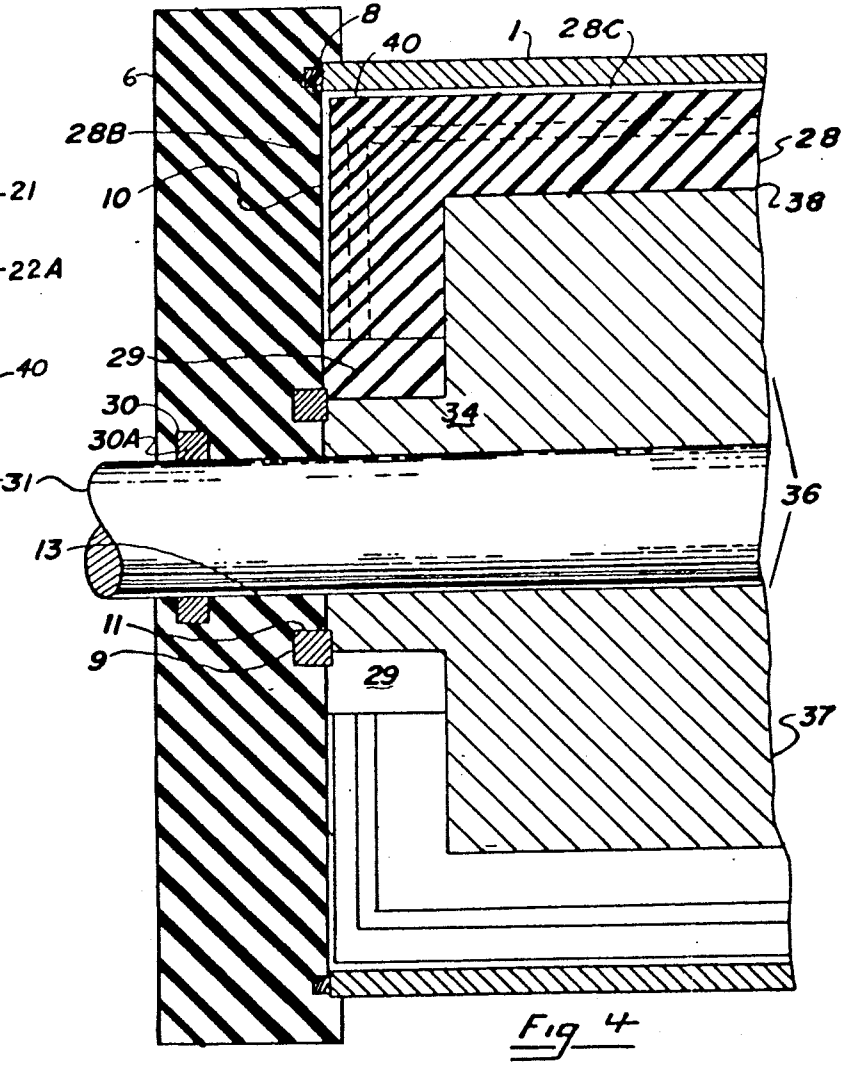
FIG. 4, is a cross section view of the arrangement of FIG. 2 taken along a plane passing through line 4—4 of FIG. 2.

With reference to FIG. 4 the sealing engagement between vane seals 28, head 6 and body member 1 is shown. More particularly in FIG. 4 lip 28B of a seal 28 of vane 37 is shown in sealing relation on inset surface 10 of head 6 and also with the inner surface of body 1. Lip 28C of seal 28 engages the inner surface of body 1.

FIG. 4 also illustrates the engagement between ring seal 11 which is received in groove 9 in spaced relation from apertures 13, and the outer surface of pad 29 of each seal 28. The view further illustrates that ring seal 11 also engages a protion of the end of enlarged portion 34 of rotor assembly 36 to provide a seal so that there is no need to provide a seal directly on the periphery of shaft 31 as in the prior art.

Figure 5:
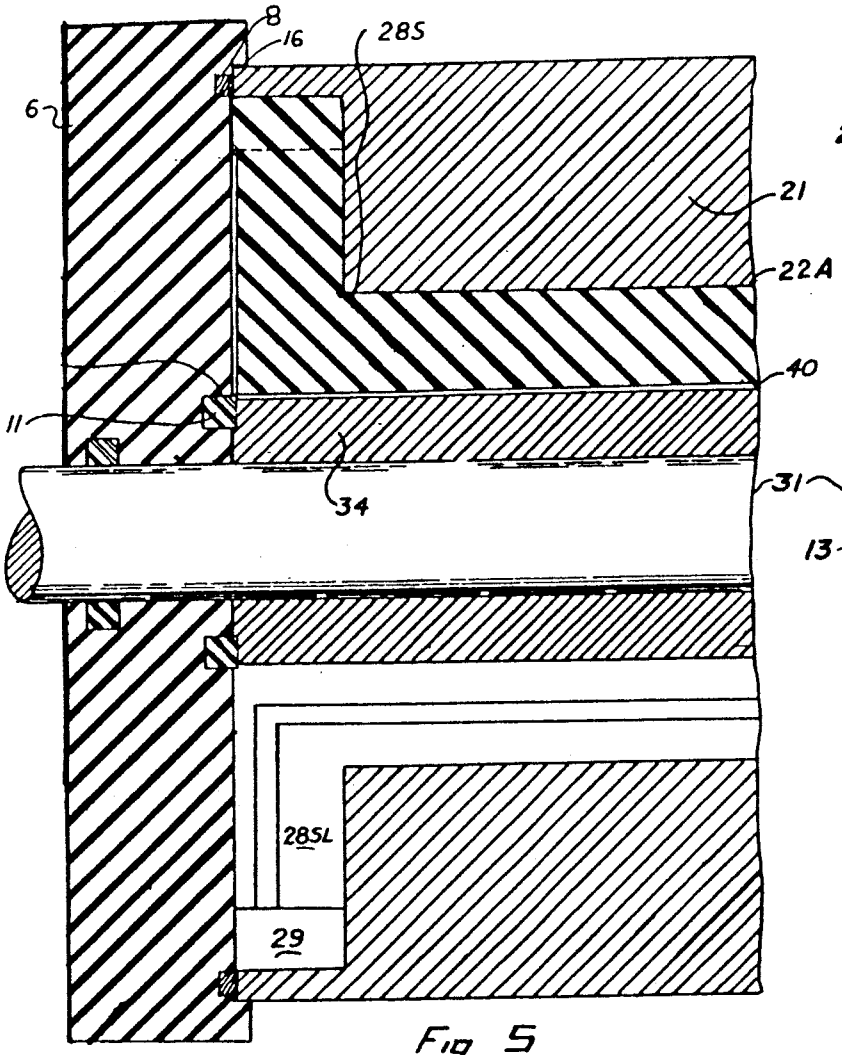
FIG. 5 is a cross section view of the arrangement shown in FIG. 2 taken along a plane passing through line 5—5 of FIG. 2.

As can be seen from FIG. 5 which illustrate the sealing provided for stators 21 it will be recognized that the ends 22A of stator assemblies 21 are adjacent to the enlarged portion 34 of rotor assembly 36. Seal 11 is shown and illustrates that seal member 11 bears both on the outer periphery of enlarged portion 34 of shaft assembly 36 and the lip portions 40 of stator seal 28S of stator 21 to provide sealing.

Body member 1 is shown as it contacts seal 16 in groove 8 of head member 6 with stators 21 as shown. Pad 29 of seal 28S is shown engaging the inside surface of head 6 and the inner surface of body member 1 at the joint thereof.

It will be recognized that the foregoing are but a few examples of arrangements within the scope of the present invention and it will be understood that other arrangements within the scope of the present invention will occur to those skilled in the art upon reading of the disclosure set forth hereinbefore.

The invention claimed is:

1. A one piece tubular housing member for a rotary fluid powered actuator including a generally right cylindrical housing of circular cross section about a longitudinal axis defining a cylindrical chamber with two open ends; at least one stator means extending generally the length of said housing and extending radially inwardly from the inner surface of the housing and having a terminating edge generally parallel to, and a selected distance from said longitudinal axis of said housing where said cylindrical housing includes at least two bolt receiving lobe means extending parallel to said longitudinal axis and terminating adjacent said open ends where the surfaces of said cylinder, including said lobes and said stator means are straight without lateral appendages and where said lobe means is of selected diameter extending a portion of the length of the housing to receive bolt means of selected cross sectional configuration to engage a portion of the inner surface of said lobe apertures.

2. A one piece tubular housing member for a rotary fluid powered actuator including a generally right cylindrical circular cross section about a longitudinal axis defining a cylindrical chamber with two open ends; at least one stator means extending generally the length of said housing and extending radially inwardly from the inner surface of the housing and having a terminating edge generally parallel to, and a selected distance from said longitudinal axis of said housing where said cylindrical housing includes at least two bolt receiving lobe means extending parallel to said longitudinal axis and terminating adjacent said open ends where the surfaces of said cylinder, including said lobes and said stator means are straight without lateral appendages and where said lobe means is of selected diameter extending a portion of the length thereof to receive bolt means of selected cross sectional configuration to engage a portion of the inner surface of said lobe apertures; first and second head means to be received over said first and second open ends of said housing where at least one of said first and second head means have central aperture means in aligned relation with the longitudinal axis of said housing and is adapted to receive said bolt means to secure said head means to said open ends of said housing; and shaft means located within said housing in aligned relation with said longitudinal axis and received in said central aperture means where a portion of the outer periphery of said shaft means is disposed adjacent said edge of said stator means and said shaft means includes vane means extending radially outwardly from said shaft means to selectively engage said stator means to limit the arc of rotation of said shaft in said housing to less than 360°.

3. The invention of claim 2 wherein at least one of said first and second heads include fluid aperture means for selective admission and emission of fluid to said chamber to provide pressure differential on opposite sides of said vane means in response thereto.

4. The invention of claim 3 wherein said stator means includes seal means along the periphery thereof to engage said shaft means and said head means to prevent fluid passage around said stator means.

5. The invention of claim 3 wherein said vane means includes seal means along a portion of the periphery thereof to engage said first and second head means and the inner surface of said housing chamber to prevent leakage of fluid past said vane means.

* * * * *